US006098716A

United States Patent [19]

Hromas et al.

[11] Patent Number: 6,098,716

[45] Date of Patent: Aug. 8, 2000

[54] RELEASABLE CONNECTOR ASSEMBLY FOR A PERFORATING GUN AND METHOD

[75] Inventors: Joe C. Hromas; Klaus B. Huber, both of Sugar Land, Tex.

[73] Assignee: Schlumberger Technology Corporation, Sugar Land, Tex.

[21] Appl. No.: 09/121,133

[22] Filed: Jul. 22, 1998

Related U.S. Application Data

[60] Provisional application No. 60/053,532, Jul. 23, 1997.

[51] Int. Cl.[7] ..... E21B 19/16

[52] U.S. Cl. ..... 166/377; 166/242.6; 166/297

[58] Field of Search ..... 166/297, 55.1, 166/377, 376, 242.6, 298, 55, 317; 175/4.54, 4.58

[56] References Cited

U.S. PATENT DOCUMENTS

| | | | |
|---|---|---|---|
| 4,776,393 | 10/1988 | Forehand et al. | 166/55.1 |
| 5,366,014 | 11/1994 | George | 166/297 |
| 5,490,563 | 2/1996 | Wesson et al. | 166/297 |
| 5,509,481 | 4/1996 | Huber et al. | 166/297 |
| 5,513,703 | 5/1996 | Mills et al. | 166/55.1 |
| 5,778,979 | 7/1998 | Burleson et al. | 166/277 |

FOREIGN PATENT DOCUMENTS 0 647 765 A2 4/1995 European Pat. Off. .

*Primary Examiner*—David Bagnell
*Assistant Examiner*—Zakiya Walker
*Attorney, Agent, or Firm*—Dan C. Hu

[57] ABSTRACT

An apparatus for releasably coupling a perforating gun to a string includes a tubular member to couple the perforating gun to the string and a latch. The latch connects the perforating gun to the tubular member before detonation of the perforating gun. In response to the detonation of the perforating gun, the latch disconnects the perforating gun from the tubular member after the expiration of a predetermined duration of time.

14 Claims, 5 Drawing Sheets

RELEASABLE CONNECTOR ASSEMBLY FOR A PERFORATING GUN AND METHOD

This application claims, pursuant to 35 U.S.C. § 119, the benefit of to U.S. Provisional Patent Application Ser. No. 60,053,532, filed on Jul. 23, 1997.

BACKGROUND

The invention relates to a releasable connector assembly for a perforating gun.

It is often desirable to automatically disconnect a perforating gun from a string after detonation of the perforating gun. This is especially true in permanent completions where no additional wireline or string runs are desired. The automatic disconnection of the perforating gun may be desirable because in certain formations, an inflow of formation fluids follow detonation and cause the perforating gun to "sand up" and become stuck in the casing. Many such automatic releases are available from various manufacturers. A difficulty with some of these above-described arrangements may be that the perforating gun falls to the bottom of the well after detonation, and thus, the perforating gun is not recoverable.

To address this problem, some perforating gun strings may include modular perforating gun sections that automatically disconnect in a manner that allow the sections to be retrieved from the well after detonation. However, a problem with this approach is that the detonation of downhole explosives and/or the inrush of well fluid may propel the disconnected sections up the wellbore and damage or "blow up" the well.

Thus, there exists a continuing need for a perforating system having sections that automatically disconnect after detonation and do not pose a danger to the well after disconnection.

SUMMARY

In one embodiment of the invention, an apparatus for releasably coupling a perforating gun to a string includes a latch and a tubular member to couple the perforating gun to the string. The latch connects the perforating gun to the tubular member before detonation of the perforating gun, and in response to the detonation of the perforating gun, the latch automatically disconnects the perforating gun from the tubular member after the expiration of a predetermined duration of time.

In another embodiment, a method includes connecting a perforating gun to a string and detonating the perforating gun. In response to the detonation of the perforating gun, the method includes automatically waiting for a predetermined duration of time and at the expiration of the predetermined duration of time, automatically disconnecting the perforating gun from the string.

Other embodiments will become apparent from the following description, from the drawings and from the claims.

DETAILED DESCRIPTION

Figure 1:
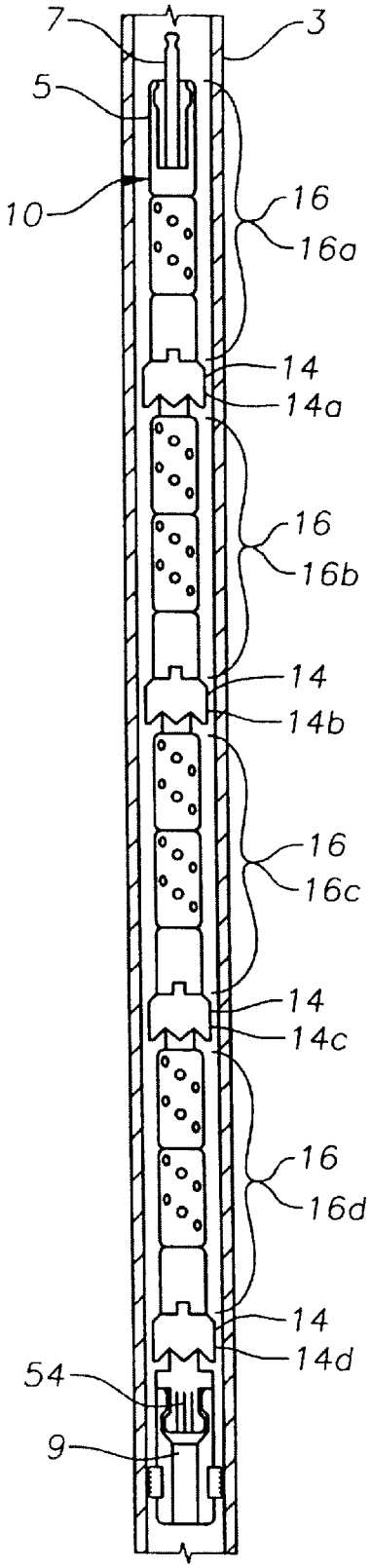
FIG. 1 is a schematic diagram of a perforating gun string according to one embodiment of the invention.
Figure 2A:
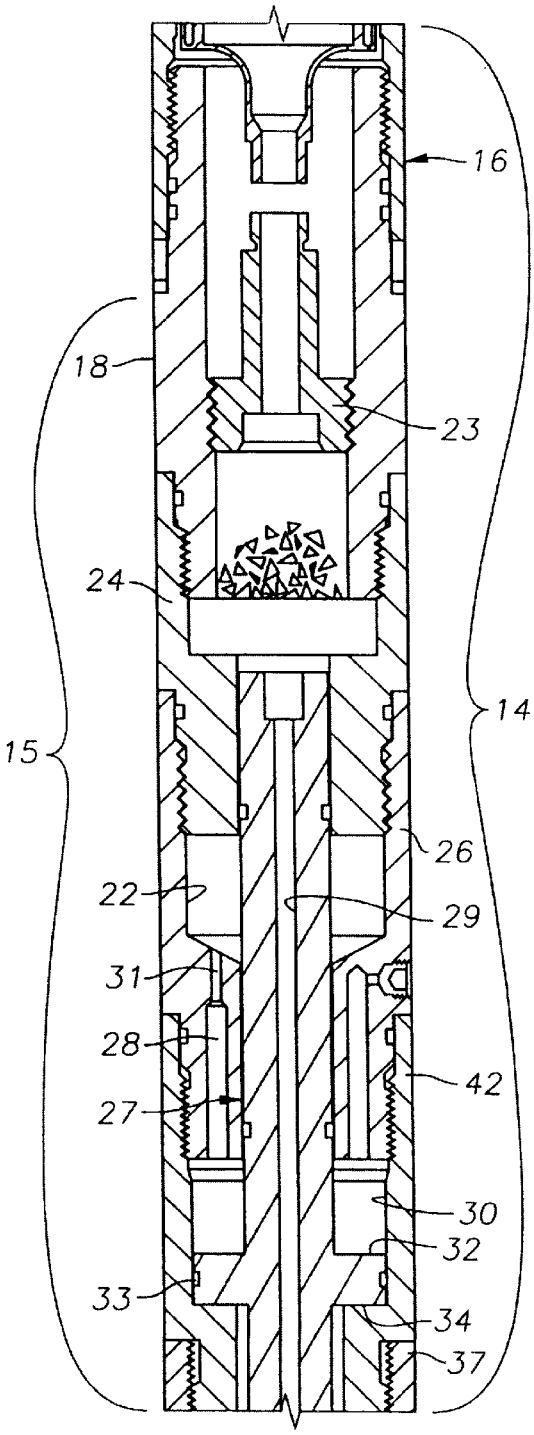
FIGS. 2A and 2B are schematic diagrams of a releasable connector assembly that couples two perforating gun sections of the string of FIG. 1 together after detonation of the upper perforating gun section.
Figure 2B:
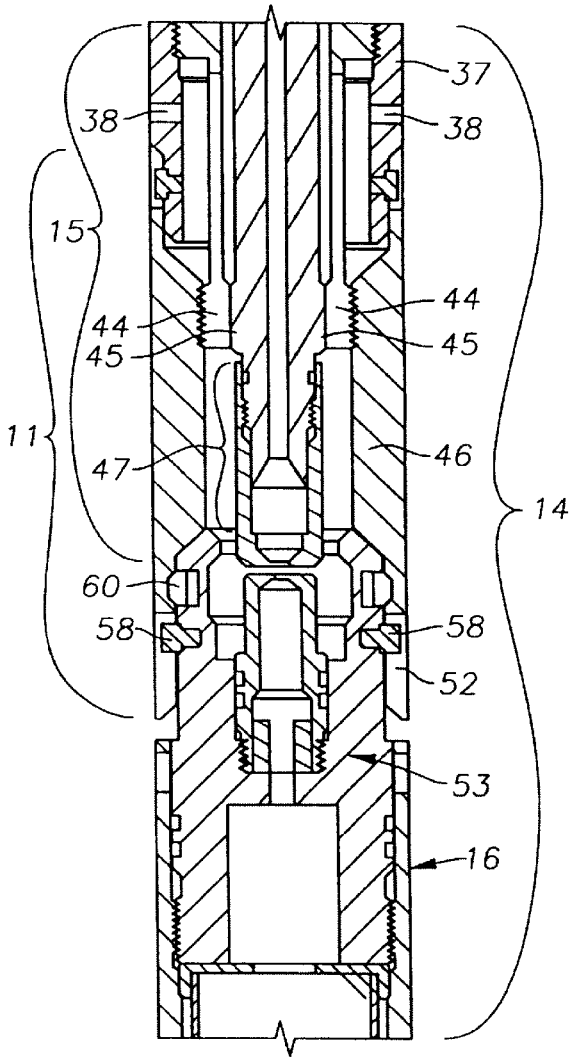

Referring to FIG. 1, an embodiment 10 of a perforating gun string in accordance with the invention includes modular perforating gun sections 16 (perforating gun sections 16*a*, 16*b*, 16*c* and 16*d*, as examples) which are releasably coupled together by connector assemblies 14 (assemblies 14*a*, 14*b*, 14*c* and 14*d*, as examples). Referring also to FIGS. 2A and 2B, each connector assembly 14 (shown entirely assembled in FIGS. 2A and 2B) includes a latch 15, a tubular member 11 that receives the latch 15, and a generally cylindrical adapter sleeve 53 that couples the tubular member 11 to a perforating gun section 16 that is located downhole of the connector assembly 14.

Figure 4A:
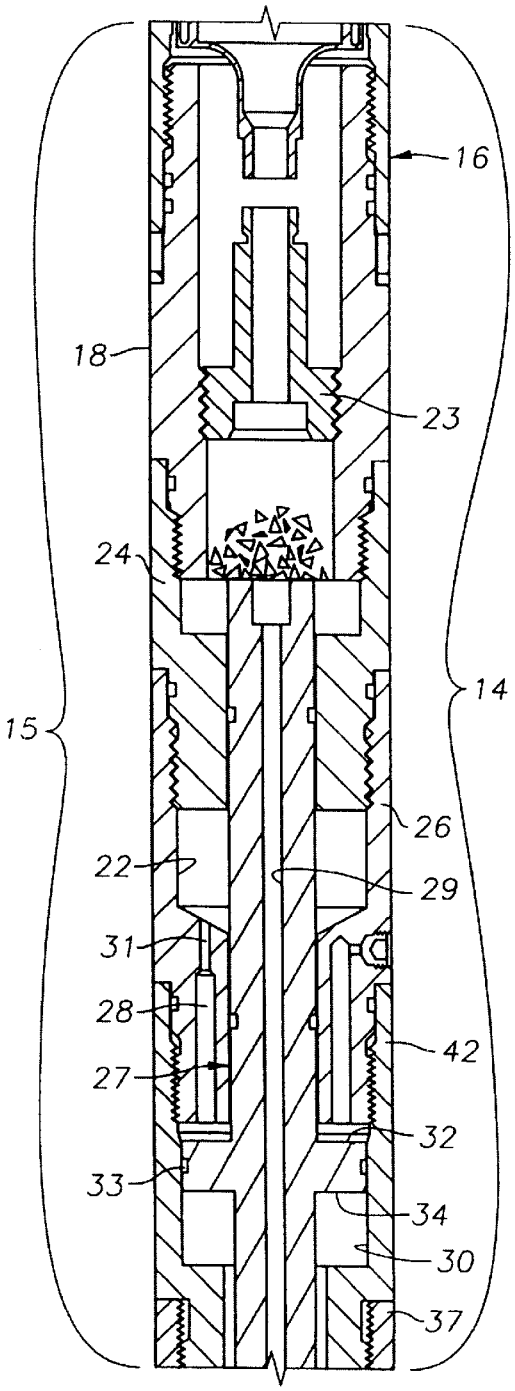
FIGS. 4A and 4B are schematic diagrams of the connector assembly after automatically releasing the lower perforating gun in response to detonation of the upper perforating gun section.
Figure 4B:
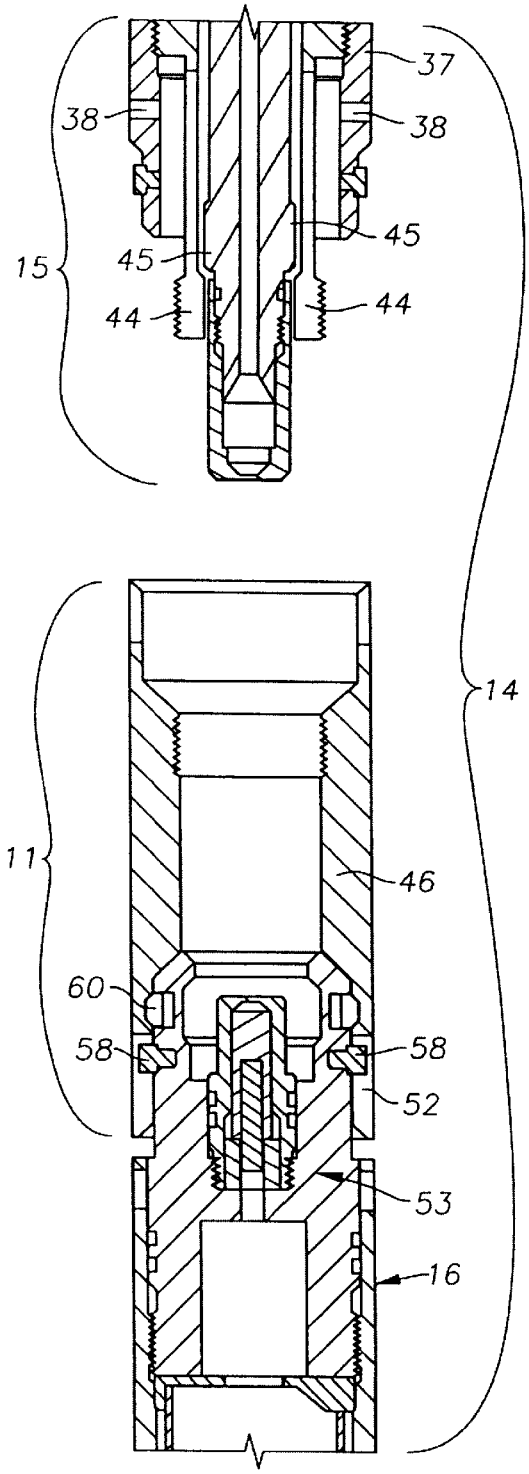

The perforating gun section 16 that is above the connector assembly 14 in the gun string 10 is fixedly secured to the connector assembly 14. When this upper perforating gun section 16 detonates, the latch 15 of the connector assembly 14 automatically disconnects (after a predetermined duration of time, as described below) the upper perforating gun section 16 from the remaining portion of the string 10 by releasing the latch's hold on the tubular member 11, as shown in FIGS. 4A and 4B. As an example, the perforating gun section 16*c* (see FIG. 1) is secured to the downhole connector assembly 14*c* which releasably couples the perforating gun section 16*c* to the downhole perforating gun section 16*d*. After the perforating gun section 16*c* detonates, the connector assembly 14*c* disconnects the perforating gun section 16*c* from the perforating gun section 16*d* and thus, disconnects the perforating gun section 16*c* from the remaining portion of the anchored string 10.

Thus, as a result of the connector assemblies 14, after each perforating gun section 16 detonates, the perforating gun section 16 is automatically disconnected from the remaining portion of the downhole perforating gun string. In this manner, each perforating gun section 16 may be retrieved after the perforating gun section 16 detonates. The perforating gun sections 16 are each of a sufficiently short length (40 feet, for example) to allow the perforating gun section 16 to be retrieved into a riser of a well without killing the well.

If each perforating gun section were to immediately disconnect after detonation of the section 16, then there might be a possibility of the disconnected perforating gun section 16 "blowing up the hole" due to detonation of downhole explosives and/or the increased upward pressure caused by the inrush of well fluids. To prevent this scenario from occurring, the connector assembly 14 delays for a predetermined duration (40 to 60 seconds, for example) before automatically releasing the perforating gun section 16, as described below.

Figure 3A:
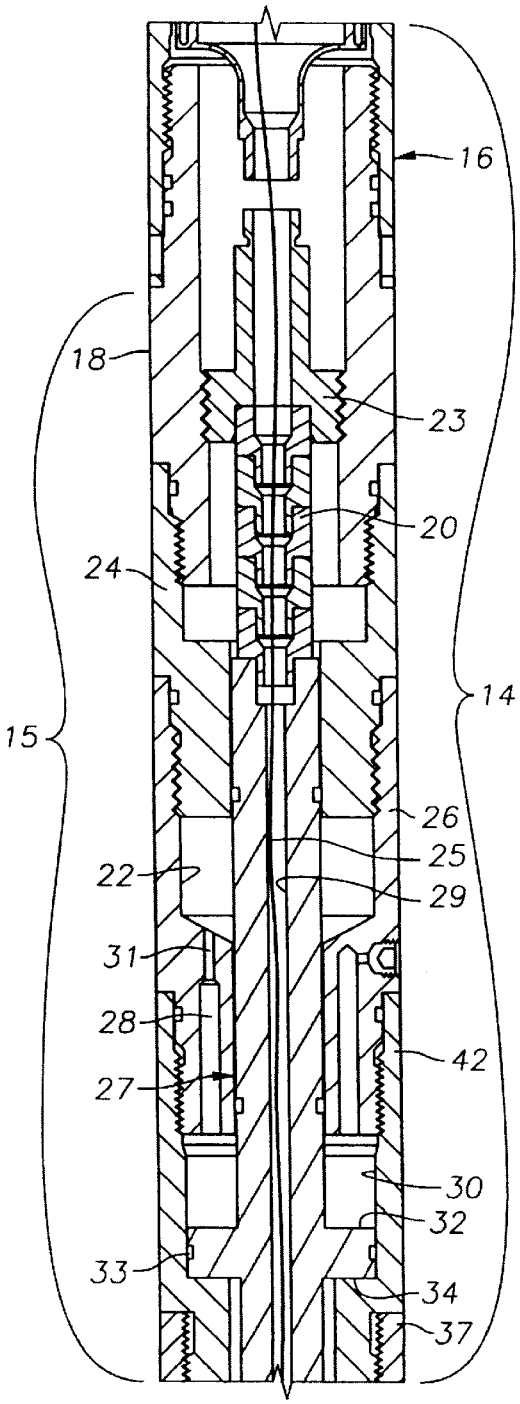
FIGS. 3A and 3B are schematic diagrams of the connector assembly after being mechanically disconnected before detonation of the upper perforating gun section.
Figure 3B:
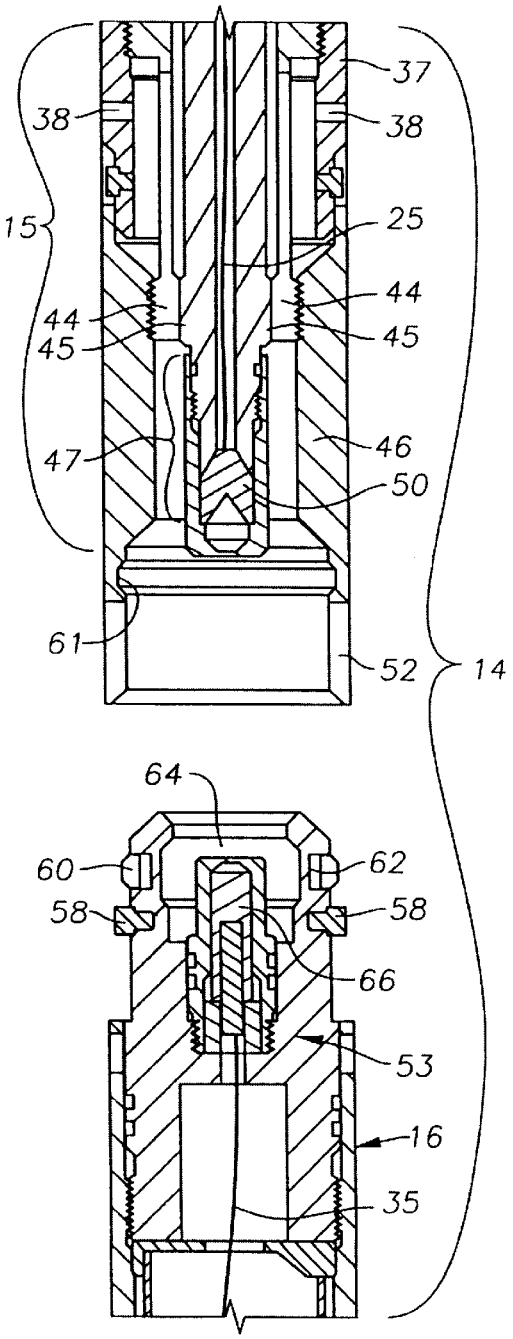

In addition to automatically disconnecting the perforating gun section 16, the connector assembly 14, in some embodiments, may be mechanically actuated to cause the connector assembly 14 to release the lower perforating gun section 16 and allow the upper perforating gun section 16 to be removed. In this manner, the mechanical actuation causes the tubular member 11 to disconnect from the adapter sleeve 53 and thus, mechanically release the lower perforating gun section 16, as shown in FIGS. 3A and 3B. The mechanical actuation may include applying a predetermined force profile to the connector assembly 14 to cause this release, as described below.

Thus, the advantages of the above-described system may include one or more of the following: the modular design of the string 10 may permit the perforating gun sections 16 to be stacked to achieve desired shooting intervals; the perforating gun sections 16 may be able to disconnect in sections short enough to be retrieved into the riser without killing the well; the possibility of the automatic disconnection causing the perforating gun section 16 to damage or "blow up the hole" may be substantially reduced; and the perforating gun section 16 may be mechanically disconnected if an emergency or a failure of the perforating gun section 16 (or string 10) occurs.

Referring back to FIG. 1, in some embodiments, the perforating gun string 10 may be assembled in the well in the following manner. First, a mechanically releasable anchor (MRA) 9 is secured to a casing 3 of the well with a propellant type setting tool and adapter kit similar to an assembly that might be used to set a bridge plug. The MRA 9 serves as an anchor for the perforating gun string 10 onto which the perforating gun sections 16 are stacked. In this manner, the MRA 9 is run into the borehole and set on depth. Once the cable and setting tool are retrieved, an MRA latch 54 is run into the hole with a running/retrieval tool (a GS-type tool, for example) and latched into an internal profile of a top sub of the MRA 9.

Once the MRA latch 54 is latched onto the MRA 9, the perforating gun sections 16 are then run into the borehole, stacked one on top of the other and latched as described above. The top perforating gun section 16*a* may include a fill sub 5 that houses a firing head 7 for the perforating gun string 10. If tubular member conveyed perforating (TCP) is used, the top perforating gun section 16*a* is run into the borehole and latched to the other portion of the perforating gun string 10 just before the perforating gun sections 16 are to be detonated.

Referring back to FIGS. 2A and 2B, in one embodiment, to accomplish the above-described features, the latch 15 includes release fingers 44 that, before detonation of the uphole perforating gun section 16 (and for a predetermined duration of time thereafter), exert force on the inner surface of the tubular member 11 to secure the latch 15 to the tubular member 11. To accomplish this, the release fingers 44 are pushed radially outwardly into the inner surface of the tubular member 11 by a cylindrical upset 45 of a release piston 27 that extends along a longitudinal axis of the latch 15 (and gun string 10). The fingers 44 collectively surround the release piston 27 and are responsive to the outer profile of the release piston 27. As a result, the release fingers 44 are pushed radially outwardly by the upset 45. In some embodiments, the release fingers 44 may form a threadable connection with the inner surface of the tubular member 11 when the release fingers 44 contact the upset 45.

After detonation of the upper perforating gun section 16, the predetermined time delay begins. To accomplish this, the release piston 27 slowly (as described below) moves in an upward direction (with respect to the fingers 44), and as a result, the upset 45 is gradually moved away from the vicinity of the fingers 44. As a result, eventually, a smaller diameter section 47 of the release piston 27 passes between the fingers 44 and causes the fingers 44 to retract radially inwardly and release the forces on the inner surface of the tubular member 11. When this occurs, the latch 15 (and the upper perforating gun section 16 to which the latch 15 is secured) releases its bold on the tubular member 11. The upper perforating gun section 16 may then be removed, as shown in FIG. 4. After the release, the tubular member 11 remains attached to the remaining portion of the perforating gun string 10 via the adapter sleeve 53.

Still referring to FIGS. 2A and 2B, for purposes of preventing the release piston 27 from moving until the perforating gun section 16 above the connector assembly 14 detonates, the latch 15, in some embodiments, includes a break plug, or frangible plug 20, that is made from a frangible material (ductile metal, for example) that is susceptible to a detonation shockwave. The frangible plug 20 is wedged between the top of the release piston 27 and a stationary section 23 (of the latch 15) which prevents the releasable piston 27 from moving until detonation of the perforating gun section 16, as described below. To accomplish this, the frangible plug 20 has a hollow center which houses a detonating cord 25 that extends through the frangible plug 20 and through the connector assembly 14. The detonating cord 25 propagates a shockwave when the uphole perforating gun section 16 detonates. This shockwave shatters the frangible plug 20 (see FIGS. 3A and 3B) which removes the longitudinal restraint on the release piston 27 and allows the piston 27 to move slowly in an upward direction.

During the ascent of the release piston 27, the velocity of the release piston 27 is limited, as described below. The upward movement of the release piston 27 is caused by hydrostatic pressure on a lower surface 34 of a piston head 33 of the release piston 27. The hydrostatic pressure, in turn, is caused by well fluid that enters through radial portholes 38 in the latch 15. The fluid is routed inside the latch 15 through internal passageways (not shown) to the lower surface 34 of the piston head 33. The force on the lower surface 34 on the piston head 33 causes the release piston 27 to move upward which eventually removes the upset 45 from the vicinity of the release fingers 44.

To create the predetermined disconnection delay, the latch 15 includes an air chamber 22 and an oil chamber 30 to limit the upward velocity of the release piston 27 and thus, limit the time for the upset 45 to clear the release fingers 44. To accomplish this, the oil chamber 30 is filled with oil which contacts an upper surface 32 of the piston head 33. Fluid communication is established between the air 22 and oil 30 chambers via a passageway 28 which directs oil from the chamber 30 to a metering orifice 31. The orifice 31 effectively meters the rate at which the oil flows from the oil chamber 30 to the air chamber 22. As a result of this arrangement, the orifice 31 effectively establishes a rate at which the release piston 27 moves after the frangible plug 20 shatters and thus, establishes the predetermined disconnection delay.

The mechanical release of the tubular member 11 from the adapter sleeve 53 is controlled by a slotted index sleeve 52 (described below) which, when the appropriate force profile is applied, interacts with index pins 58 of the adapter sleeve 53 to mechanically disconnect the tubular member 11 from the adapter sleeve 53. To accomplish this, index pins 58 radially extend from the adapter sleeve 53, and each index pin 58 is received by a different associated slotted index groove 70 (see FIG. 5) in the index sleeve 52.

Figure 5:
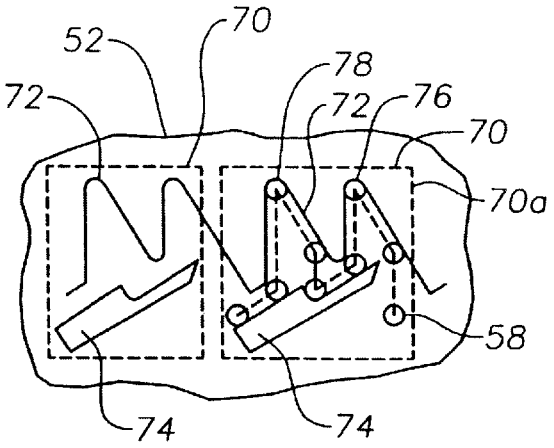
FIG. 5 is a side view of index grooves of an index sleeve of the connector assembly.

Referring to FIG. 5, as an example, the index groove 70 may be formed by an upper, sawtooth raised shoulder profile 72 and a lower inclined shoulder profile 74. The ridges of the sawtooth shoulder profile 72 form positions for limiting downward movement of the tubular member 11 with respect to the adapter sleeve 53. For example, for an exemplary index groove 70*a*, when the tubular member 11 is first fitted onto the adapter sleeve 53, the index pin 58 rests in an upper vertex 76 of the shoulder profile 72. When sufficient force is applied to move the tubular member 11 upwardly with respect to the adapter sleeve 53, the index pin 58 moves down and contacts the lower shoulder profile 74. Due to an inclined groove, or stop 75, on the shoulder profile 74, the index pin 58 rests on the stop 75 until the upward force is relaxed which allows the index pin 58 to move upwardly to another upper vertex 78 of the shoulder profile 72. When another sufficient upward force is applied to the tubular member 11, the index pin 58 moves back to the shoulder 74, this time escaping the stop 75, which allows the index pin 58 to leave the index groove 70*a*. This same sequence occurs for the other index pin(s) 58 in the other index groove(s) 70 which allows the tubular member 11 to be disconnected from the adapter sleeve 53.

Thus, the index grooves 70 in conjunction with the index pins 58 form a mechanism that requires a predetermined force profile to disassemble the connector assembly 14. In this manner, to mechanically remove a perforating gun section 16, a predetermined upward force (a force of at least 200 lbs., as an example) is first applied to the connector assembly 14, this force is then relaxed and then another predetermined upward force (another force of over 200 lbs., as an example) is applied to the connector assembly 14 to separate the tubular member 11 (and connected perforating gun section 16) from the adapter sleeve 53 (and the remaining anchored portion of the perforating gun string 10).

In some embodiments, the tubular member 11 may be formed from the index sleeve 52 and an upper tubular alignment housing 46. The alignment housing 46 is coaxial with the longitudinal axis of the connector assembly 14 and secured to the alignment housing 46 to form the tubular member 11. The inner surface of the alignment housing 46 contacts the release fingers 44 when the upset 45 contacts the release fingers 44 and, in some embodiments, the inner surface may include threads for threadably coupling the alignment housing 46 to the release fingers 44. An anti-rotation collar 37 (coaxial with the alignment housing 46) is generally coupled above the alignment housing 46, and rotation lock screws 43 may radially extend through the alignment housing 46 and into the collar 37 to prevent the alignment housing 46 from rotating.

A mandrel 42 is coaxial with and secured to the anti-rotation collar 37. Part of the mandrel 42 rests on top of the anti-rotation collar 37, and the lower portion of the mandrel 42 is integral with the release fingers 44 which extend inside the anti-rotation collar 37 and down into the alignment housing 46. An interior portion of the mandrel 42 forms the oil chamber 30 and receives the piston head 33.

The mandrel 42 is threadably coupled to an orifice housing 26 that is also coaxial with the mandrel 42 and is generally located above the mandrel 42. The orifice housing 26 circumscribes the release piston 27 and has an interior region that forms the air chamber 22. The orifice housing 26 also includes the orifice 31 and the passageway 28.

The orifice housing 26 may be threadably coupled to a coaxial frangible plug housing 24 that has an interior for receiving the frangible plug 20. The frangible plug housing 24, in turn, may be threadably coupled to a coaxial upper adapter section 18 which threadably couples the latch 15 to the upper perforating gun section 16.

Other features of the latch 15 include a trigger charge 50 (see FIG. 3B) that is located near the bottom of the latch 15. The trigger charge 50 is in contact with the detonating cord 25 to relay a detonation to the adapter sleeve 53. In this manner, the trigger charge 50 initiates a relay booster 66 in the adapter sleeve 53 to propagate the detonation down a detonating cord 35 that extends to the lower perforating gun section 16.

In some embodiments, a detent ring 60 rests in an annular, detent ring channel 62 of the adapter sleeve 53 when the connector assembly 14 is assembled. In this manner, the outer surface of the detent ring 60 contacts an associated annular channel 61 of the alignment housing 46 to mechanically secure the alignment housing 46 (and index sleeve 52) to the adapter sleeve 53. The detent ring 60 is designed to gradually collapse under pressure so that when a predetermined upward force (a 200 lb. force, for example) is applied to the alignment housing 46, the detent ring 60 is compressed radially inwardly into the channel 62 (and out of the channel 61) so that the alignment housing 46 is no longer secured to the adapter sleeve 53 by the detent ring 60.

A predetermined upward force sufficient to overcome the restraint imposed by the detent ring 60 may be inadvertently applied, for example, when one or more perforating gun sections 16 detonate. However, even if the detent ring 60 is compressed due to this inadvertent force, the tubular member 11 does not separate from the latch 15 due to the interaction of the index pins 58 with the index grooves 70 of the index sleeve 52. Thus, if the detent ring 60 is compressed during a detonation of a particular perforating gun section 16, the index pins 58 move only to the first vertex 76 (and not to the second vertex 78) of the respective index grooves 70.

Figure 6:
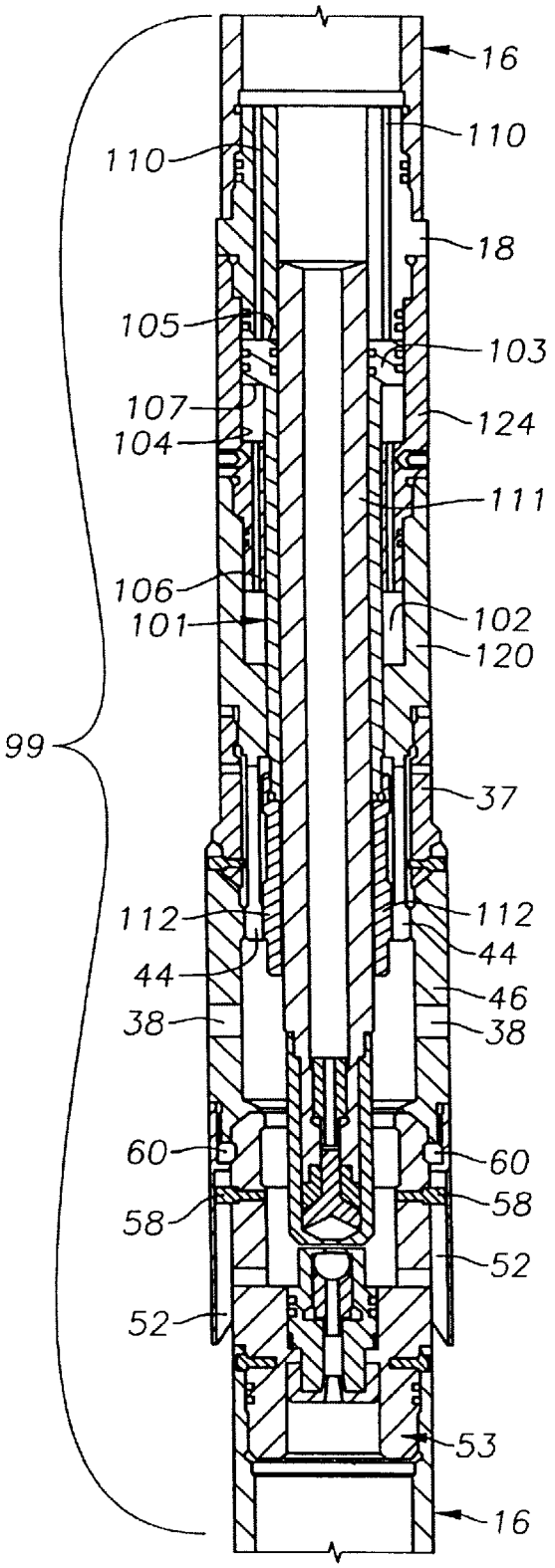
FIG. 6 is a schematic diagram of a connector assembly according to another embodiment of the invention.

Referring to FIG. 6, in some embodiments, the connector assembly 14 may be replaced by a connector assembly 99. The connector assembly 99 has features similar to the connector assembly 14, with some of the differences being pointed out below. In particular, the connector assembly 99 does not include the frangible break plug 20. Instead, the connector assembly 99 uses pressure in an air chamber 102 to hold a tubular release piston 101 (that replaces the release piston 27) in place until the downhole perforating gun 16 has been detonated. When the release piston 101 is released, (as described below), the release piston 101 travels in a downward direction (instead of an upward direction), and downward velocity of the release piston 101 is dampened by oil in an oil chamber 104 to form the predetermined disconnection delay. The release piston 101 circumscribes and is coaxial with an inner tubular member 111 that remains stationary with respect to the release piston 101 when the release piston 101 moves. The tubular member 111 extends along the longitudinal axis of the connector assembly 99 and may be threadably connected to the upper adapter section 18.

The oil chamber 104 is in fluid communication with the air chamber 102 which is pressurized to a pressure that is sufficient to hold the release piston 101 in place until the upper perforating gun section 16 has detonated. However, once detonated, hydrostatic pressure from the fluid (that surrounds the connector assembly 14 in the well) produces a force on an upper surface 105 of a piston head 103 of the release piston 101 to cause the release piston 101 to move in a downward direction. This movement causes a lower surface 107 of the piston head 103 to place force on the oil in the oil chamber 104 which forces the oil into the air chamber 102 via an orifice 106.

Like the orifice 31, the orifice 106 meters the rate at which the oil flows from the oil chamber 104 into the air chamber 102 and thus, meters the rate at which the release piston 101 moves downwardly. Release fingers 44 contact an upset 112 of the release piston 101 and exert force on the inside surface of the alignment housing 46 as long as the upset 112 contacts the release fingers 44. When the release piston 101 moves a sufficient distance, the upset 112 no longer contacts the release fingers 44, thereby allowing the release fingers 44 to release the hold on the inner surface of the alignment housing 46. The fluid is furnished to the upper surface 105 of the piston head 103 via passageways (passageways 110, as examples) inside the upper adapter 18.

The air chamber 102 is formed from an interior region of a mandrel 120 (that replaces the mandrel 42), and the oil chamber 104 is formed from an inner chamber of an orifice housing 124 (that replaces the orifice housing 26). This inner chamber of the orifice housing 124 also is adapted to receive the piston head 103.

While the invention has been disclosed with respect to a limited number of embodiments, those skilled in the art will, having the benefit of this disclosure, appreciate numerous modifications and variations therefrom. It is intended that the appended claims cover all such modifications and variations as fall within the true spirit and scope of the invention.

What is claimed is:

1. An apparatus for releasably coupling a perforating gun to a string, comprising:

a tubular member to couple the perforating gun to the string; and a latch to connect the perforating gun to the tubular member before detonation of the perforating gun, and in response to detonation of the perforating gun, to maintain the connection of the perforating gun to the tubular member while measuring a predetermined duration of time and to disconnect the perforating gun from the tubular member after the expiration of the predetermined duration of time.

2. The apparatus of claim 1, wherein the perforating gun has one end adapted to mate with a tool to retrieve the perforating gun and the tubular member is coupled to an opposite end of the perforating gun.

3. The apparatus of claim 1, wherein the latch comprises:

a housing having a first chamber filled with a first fluid and a second pressurized chamber in communication with the first chamber via an orifice that establishes the predetermined duration of time, the second chamber exerting a force on the first fluid to keep the first fluid in the first chamber;

a piston having a first surface in contact with the first fluid and a second surface in contact with well fluid, wherein after detonation of the perforating gun, the well fluid exerts a force sufficient on the piston to move the piston to force the first fluid into the second chamber; and fingers to contact a contact section of the piston to exert forces on the tubular member before detonation of the perforating gun and to be isolated from the contact section to release the forces on the tubular member after detonation when the piston moves a predetermined distance.

4. The apparatus of claim 1, wherein the latch comprises:

a detonating cord for receiving a shockwave when the perforating gun is detonated;

a frangible plug in contact with the detonating cord to shatter when the shockwave is received by the detonating cord; and a connector supported by the frangible plug to couple the perforating gun to the tubular member before the frangible plug shatters and disconnect the perforating gun from the tubular member after the frangible plug shatters.

5. The apparatus of claim 4, wherein the connector comprises:

a piston to be held in place by the frangible plug before the frangible plug shatters and to move after the frangible plug shatters, the piston having a contact section; and fingers to contact the contact section of the piston to exert forces on the tubular member when the piston is held in place by the frangible plug and to be isolated from the contact section to release the forces on the tubular member after the piston moves a predetermined distance.

6. The apparatus of claim 5, wherein the piston has a first surface in contact with a fluid to move the piston after the frangible plug shatters.

7. The apparatus of claim 5, further comprising:

a housing having a first chamber having a fluid and a second chamber in fluid communication with the first chamber, wherein the piston further has a surface in contact with the fluid to force the fluid from the first chamber to the second chamber when the piston moves, an orifice between the first and second chambers controlling the predetermined duration of time.

8. The apparatus of claim 1, further comprising:

an adapter coupled between the tubular member and the string, the adapter including an index pin and the latch including a groove to receive the index pin to releasably connect the latch to the adapter and to disconnect the latch from the adapter when a predetermined force profile is applied to the tubular member.

9. The apparatus of claim 8, wherein the predetermined force profile includes exertion of a first upward force, relaxation of the first upward force and subsequent exertion of a second upward force.

10. A method comprising:

connecting a perforating gun to a tubular member;

detonating the perforating gun; and in response to the detonation, automatically waiting for a predetermined duration of time before automatically disconnecting the perforating gun from the tubular member.

11. The method of claim 10, further comprising:

retrieving the perforating gun to a surface of a well after the disconnection.

12. The method of claim 10, further comprising:

shattering a frangible plug in response to the detonation.

13. The method of claim 10, further comprising:

coupling additional perforating guns to the first perforating gun.

14. The method of claim 10, further comprising:

pressurizing one surface of a piston before detonation of the perforating gun;

allowing pressure from well fluid to exert a pressure on an opposite surface of the piston after detonation of the perforating gun to cause the piston to move; and controlling the movement of the piston to set the predetermined duration of time.

* * * * *